United States Patent [19]

Doyle

[11] Patent Number: 5,013,246

[45] Date of Patent: May 7, 1991

[54] METHOD OF PROMOTING SELF-ESTEEM BY ASSEMBLING A PERSONALIZED KIT

[76] Inventor: Nancy L. C. Doyle, 1303 Foulk Rd., Wilmington, Del. 19803

[21] Appl. No.: 378,651

[22] Filed: Jul. 12, 1989

[51] Int. Cl.[5] ..... G09B 19/00

[52] U.S. Cl. ..... 434/236; 434/238

[58] Field of Search ..... 434/236, 237, 238, 156, 434/167, 171; 273/292, 293, 294, 148 A, 148 R, 149 R; D1/105, 112, 127, 128; D7/70, 76, 79

[56] References Cited

U.S. PATENT DOCUMENTS

| | | | |
|---|---|---|---|
| D. 157,012 | 1/1950 | Towler | D1/112 X |
| 2,435,698 | 2/1948 | Running | 273/148 A |
| 2,575,770 | 11/1951 | Roop | D7/79 X |
| 4,667,959 | 5/1987 | Pfeiffer et al. | 273/149 R |
| 4,795,156 | 1/1989 | Paulish | 273/148 R |

OTHER PUBLICATIONS

"The New York Times Magazine", p. 42, Sep. 1948, Pfaltzgraff Advertisement, Dec. 31, 1979.

*Primary Examiner*—Richard J. Apley
*Assistant Examiner*—Jennifer L. Doyle

[57] ABSTRACT

A personalized gift kit for promoting self-esteem and its method of use are disclosed. The invention promotes self-esteem, i.e., a basic human need for positive feelings about oneself, by recognizing, acknowledging, reinforcing, and encouraging the admirable and unique qualities of each individual recipient of the gift. The promotion is achieved by identifying desirable qualities of the recipient (lists of examples are provided but qualities are not limited to the lists included), recording the qualities on a personalized enclosure card and inserting preselected chips into the provided container. The chips are preprinted and/or hand printed with the appropriate corresponding qualities demonstrated by the individual who will receive the gift. The positive reflections (which can be referred to as "feedback"), embodied in the presonalized gift, assist the recipient in recognizing his own admirable qualities while increasing his/her feelings of being valued and appreciated, which enchances the individual's self-esteem.

2 Claims, 2 Drawing Sheets

METHOD OF PROMOTING SELF-ESTEEM BY ASSEMBLING A PERSONALIZED KIT

FIELD OF THE INVENTION

This invention relates to an esasily assembled, personalized gift kit which identifies and acknowledges the qualities which the presenter admires in the recipient. More particularly the invention relates to a personalized gift kit which extends and personalizes the concept of greeting cards by tapping a basic human need, namely, the need for self-esteem.

BACKGROUND OF THE INVENTION

As any psychologist will confirm, one of a human's needs is the need for self-esteem, i.e., the need for positive feelings about oneself. Self-esteem is to humanistic psychology what numbers are to mathematics, because a person's whole range of human experience, including all interpersonal relationships and behavior, are influenced by how little or how much one values oneself. In other words, a person's mental health is affected by his or her level of self-esteem. Low self-esteem is at the core of many, if not all psychological problems, including drug and alcohol abuse. Until the underlying issue—low self-esteem—is addressed, there is little hope of our winning the drug war.

One method of enhancing another's self-esteem is to provide positive "feedback" to that individual, acknowledging his/her admirable qualities and why she/he is uniquely appreciated. The "feedback" received assists the individual in recognizing and acknowledging her/his own personal attributes. Further, individuals usually experience increased feelings of personal worth and self-esteem when they feel cared for and valued by others. In addition, persons who give positive "feedback" to others also enhance their own self-esteem in the process, by having a positive focus and sharing their love and/or goodwill.

Accordingly, it is an object of this invention to provide a means of positive "feedback" indicating why the recipient of the gift is uniquely appreciated by the presenter.

It is another object to provide an easily assembled, inexpensive kit which, when assembled, serves as a personalized gift which recognizes, acknowledges, reinforces, and encourages admirable qualities of individuals of all ages, including friends, lovers, spouses, parents, grandparents, children, employees, and other close associates.

It is another object of the invention to provide a tangible reminder for the recipient of why she/he is cherished by the presenter.

Still another object is to provide an easily assembled kit which when assembled constitutes a gift which increases the feelings of lovability and self-esteem in both the presenter and recipient.

SUMMARY OF THE INVENTION

These and other objects are accomplished by providing a personalized gift kit which comprises as its essential components: a container with an opening, preferably a two-piece jug-like container with a slot; an enclosure card to identify the presenter and/or recipient for use when it is given as a gift; a set of directions for assembling the kit; and a number of chips, some of which are colored and preprinted with outstanding quality characteristics and are of a size which permit entry into the container through the aforementioned opening.

Optionally, the kit may also contain the following additional items: (1) a "write-on-anything" pen, (2) one addressed post card to the manufacturer of the kit, (3) "The Laudable 25 Sense" recognition certificate, (4) name plate, and (5) a postcard for professional personalization of name plate. The set of directions may be inserted in a folder in the kit. This folder also contains a list of over 270 qualities broken down into five categories and many subcategories. Because there is symbolic meaning associated with various colors, the list of values and/or qualities shown in Table 1 below are grouped under the color which represents or symbolizes similar qualities. The subgroups separate various facets of the symbolic meaning. Many qualities have been linked with a color through loose associations. With different interpretations, they may be linked with other colors. The Table 1 list is merely a guideline and each individual may select the qualities and color which he or she finds appropriate. It is preferred to include in the kit 51 quality currency chips in the shape of hearts—25 preprinted with quality characteristics, 25 left blank and a 26th printed chip with the wording "The Laudable 25 Sense."

DETAILED DESCRIPTION

Figure 1:
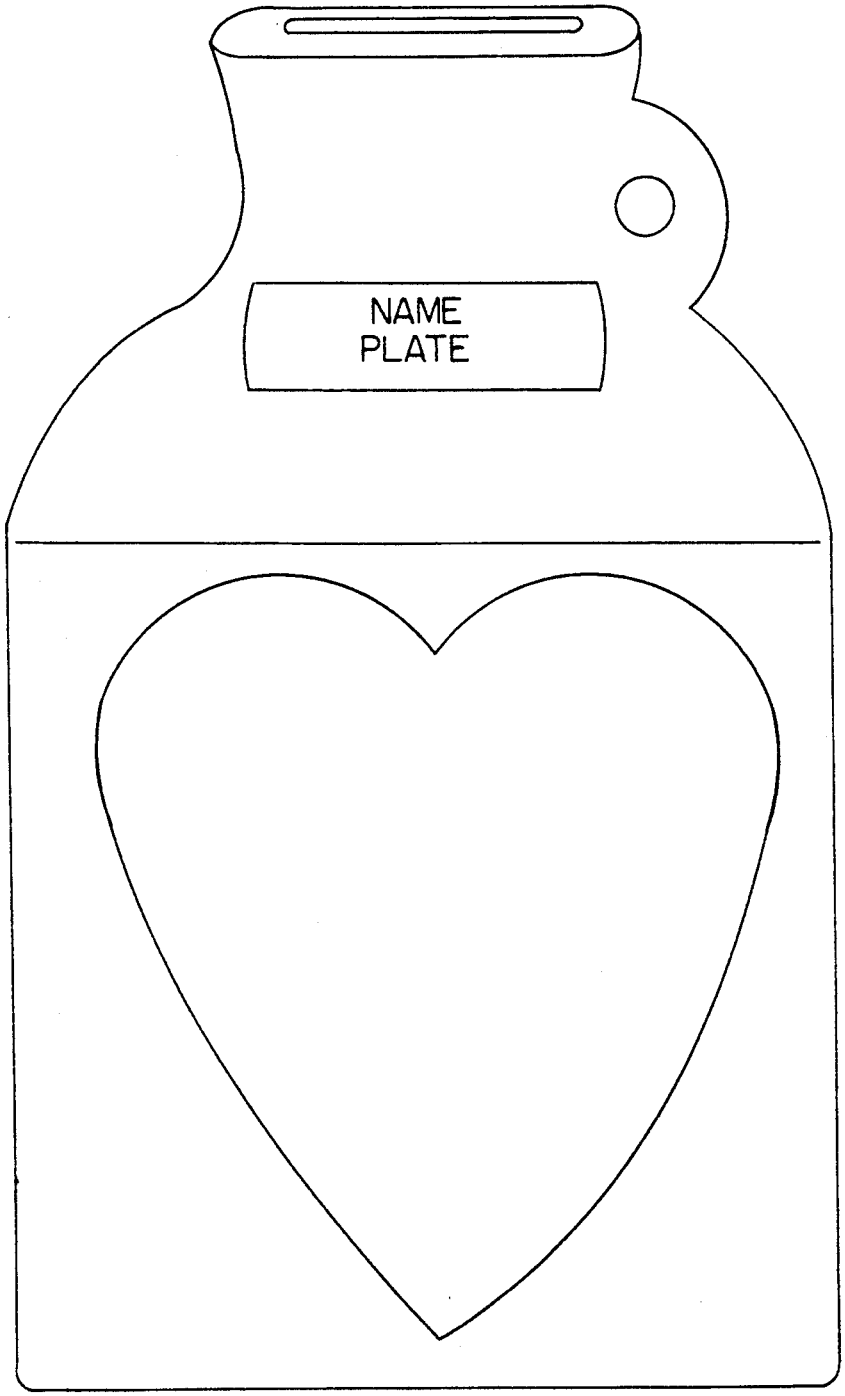
FIG. 1 is a perspective view of the jug-like container with a slot through which the quality currency chips are to be inserted.

While the invention is susceptible of embodiments in many forms, there is shown in the drawings and will herein be described in detail a specific embodiment with the understanding that the present disclosure is to be considered an exemplification of the principles of the invention and is not intended to limit the invention to the particular embodiment illustrated.

Referring to FIG. 1, the two-piece container which can be of glass, plastic or ceramic, is in the shape of a jug about 7 inches high and approximately 4½ inches in diameter. The bank-like slot at the mouth of the jug is approximately 2 inches in length, the width of the mouth being approximately 2¼ inches. In some versions there is a flange at the separation between the top and bottom portions of the jug. A name plate which can vary in size and shape but preferably is about 2 inches by ½ inch is attached to the top portion of the container by adhesive or other fastening means.

Figure 2:
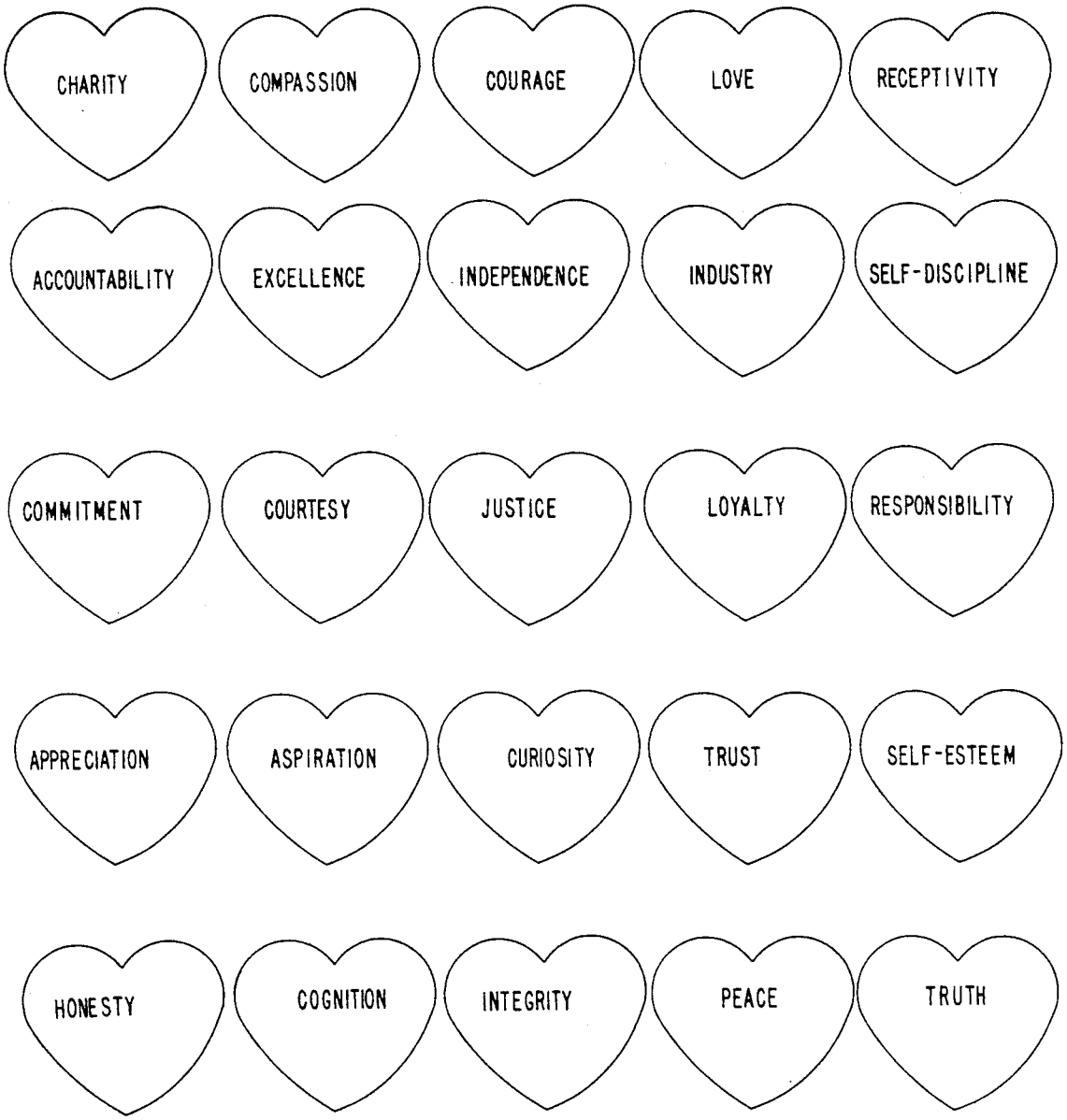
FIG. 2 is a one sided view of the preprinted quality currency chips in the shape of hearts.

Illustrated in FIG. 2 is a set of 25 preprinted quality currency chips arranged in five rows of five. The chips can be made of plastic, paper, metal or wood. In the figure, the top row preferably colored red on both sides of the heart shape chips contains the following printed words—charity, compassion, courage, love and receptivity. On the back side of each of the heart shape chips is printed the words "Quality Currency." The four rows below the top row are preferably colored orange, yellow, green and blue respectively. The twenty quality characteristics printed on the chips on the bottom four rows are accountability, excellence, independence, industry, self-discipline, commitment, courtesy, justice, loyalty, responsibility, appreciation, aspiration, curiosity, trust, self-esteem, honesty, cognition, integrity, peace, and truth.

To assemble the personalized gift from the kit of this invention the first step for the presenter, i.e., the purchaser, to perform is to identify the qualities and/or values which the presenter admires in the designated recipient. The presenter may demonstrate his or her own integrity by waiting until he or she actually observes a quality before he or she acknowledges it, even though the presenter believes the recipient may possess qualities which the presenter has not yet recognized.

The second step is for the presenter to record the qualities/values on the inside of the gift enclosure including all qualities which the presenter has identified even though some may not appear on Table 1. If there are no corresponding quality currency chips for some of the qualities which have been identified, those qualities should be printed on the blank quality currency chips using the indelible ink pen optionally enclosed in the gift kit.

TABLE 1

| RED | ORANGE | YELLOW | GREEN | BLUE |
|---|---|---|---|---|
| The sense of: | The sense of: | The sense of: | The sense of: | The sense of: |
| charity | accountability | commitment | appreciation | honesty |
| compassion | excellence | courtesy | aspiration | cognition |
| courage | independence | justice | curiosity | integrity |
| love | industry | loyalty | trust | peace |
| receptivity | self-discipline | responsibility | self-esteem | truth |
| generosity | maturity | priorities | thanksgiving | veracity |
| sharing | self-control | discretion | gratitude | sincerity |
| giving | restraint | dependability | acknowledgement | character |
| caring | autonomy | reliability | recognition | credibility |
| encouragement | assertiveness | stability | affirmation | constancy |
| nurturance | personal power | dedication | goals | standards |
| philanthropy | strength | trust- | purpose | ethics |
| altruism | abstinence | worthiness | mission | morality |
| humanity | sobriety | confiden- | vision | values |
| benevolence | determination | tiality | imagination | principles |
| helpfulness | persistence | fidelity | fantasy | idealism |
| service | diligence | allegiance | humor | vulnerability |
| concern | resiliency | patriotism | wit | humility |
| patience | endurance | faithfulness | playfulness | openness |
| empathy | fortitude | devotion | maternity | authenticity |
| understanding | tenacity | conviction | paternity | genuineness |
| sympathy | intensity | kinship | creativity | realism |
| acceptance | perseverance | comradery | innovation | humanness |
| open- | motivation | cohesiveness | generativity | communication |
| mindedness | ambition | brotherhood | ingenuity | articulation |
| tolerance | drive | sisterhood | resourcefulness | expression |
| feeling | will | savoir faire | inventiveness | innocence |
| warmth | initiative | ettiquette | complexity | wholesomeness |
| affection | precision | manners | versatility | simplicity |
| lovableness | efficiency | taste | adaptability | grace |
| intimacy | efficacy | diplomacy | spontaneity | devoutness |
| sensuality | productivity | tact | flexibility | reverence |
| sensitivity | expertise * | punctuality | conceptuali- | composure |
| emotionality | (specific) | neatness | zation | equanimity |
| gentleness | talents * | tidiness | reasonability | balance |
| tenderness | (specific) | orderliness | rationality | tranquility |
| sentimentality | pep | honor | consciousness | serenity |
| romanticism | energy | consideration | awareness | harmony |
| zest | health | respect | perception | peacefulness |
| passion | vitality | cooperation | depth | cleverness |
| exuberance | vigor | supportiveness | intuitiveness | common sense |
| fervor | posture | thoughtfulness | inquisitive- | intelligence |
| pizzazz | carriage | kindness | ness | logic |
| enthusiasm | hygiene | friendliness | astuteness | wisdom |
| radiance | cleanliness | presence | faith | knowledge |
| vibrance | | dignity | belief | |
| effervescence | | style | hope | |
| joyfulness | | culture | inspiration | |
| happiness | | attitude | optimism | |
| bravery | | disposition | spirituality | |
| leadership | | thriftiness | philosophy | |
| spunk | | frugality | charisma | |
| nerve | | economy | charm | |
| daring | | conservation | spirit | |
| resolution | | forgiveness | soul | |
| security | | freedom | essence | |
| confidence | | liberty | youth | |
| decisiveness | | impartiality | life | |
| assurance | | equality | individuality | |
| closure | | fairness | originality | |
| | | equity | self-respect | |
| | | equatibility | self- | |
| | | objectivity | acceptance | |
| | | | self- | |
| | | | confidence | |

TABLE 1-continued

| RED | ORANGE | YELLOW | GREEN | BLUE |
|---|---|---|---|---|
| | | | self-actuali- | |

* i.e.,
writing;
verbal;
artistic;
athletic;
musical;
homemaking;
professional,
etc.

The next step for the presenter in assembling the kit is to insert the appropriate quality currency chips into the slot of the container. If the presenter has identified in the recipient all 25 of the preprinted qualities, "The Laudable 25 Sense" chip is also inserted. In that case, the enclosed postcard is filled out and returned to the manufacturer with the recipient's name and address and the presenter's acknowledgment that the recipient is eligible for "The Laudable 25 Sense" Award. The recipient will then be sent a certificate in recognition of this honor.

The gift package once completely assembled is ready for presentation to the recipient. It can be delivered via mail or presented preferably in person with an accompanying warm embrace. The resulting smile on the recipient's face should bring joy to the presenter.

If there are remaining quality currency chips from the kit, they can be added to the recipient's jug at a later date as additional qualities are demonstrated and recognized.

The gift kit of the present invention is believed unique and has many advantages. Not only does the gift, easily assembled from the kit with enclosed instructions, serve a social and psychological need but it also has a universal appeal to males and females of school age through old age. Additionally it has positive symbolism, is personalized, is aesthetically appealing and while it has game-like and toy-like features the gift kit is neither a game nor a toy. The giving of the gift itself, following its assembly, gives joy not only to the one who receives it but also to the one who gives it.

It is to be understood that the kit of my invention need not be given as a gift to another. It may simply be used as a means of improving one's own self-esteem or for working with another or other individuals without actually giving the kit.

What is claimed is:

1. A method of promoting self-esteem by assembling a personalized kit whose features comprise—

(a) chips imprinted with one or more character quality words such as, but not limited to, honesty, integrity, loyalty, justice, courtesy, and responsibility;

(b) blank chips for hand printing of character quality words not found among the printed chips; and (c) a container with an opening of a size which permits the insertion of the chips through the opening; said method comprising the steps of:

identifying the character qualities and/or values recognized and admired in the designated individual for whom the said kit is being assembled;

recording on any enclosure card the identified admirable character qualities/values;

recording on the same enclosure card, the name of the recipient and the name of the presenter or the individual assembling the kit;

selecting the preprinted chips which correspond to those qualities identified and recorded;

printing, by hand, the remaining identified qualities on the blank chips;

inserting the selected preprinted chips and the hand printed chips into the container;

inscribing the recipient's name on the container;

presenting the assembled personalized kit to the recipient with an accompanying warm embrace completing the following three steps only when 25 specified qualities such as, but not limited to, Charity, Compassion, Courage, Love, Receptivity, Accountability, Excellence, Independence, Industry, Self-discipline, Commitment, Courtesy, Justice, Loyalty, Responsibility, Appreciation, Aspiration, Curiosity, Trust, Self-esteem, Honesty, Cognition, Integrity, Peace, Truth, have been identified by recipient— inserting a chip imprinted with the words, "The Laudable 25 Sense," into the container, listing those 25 specified qualities together with the recipient's name on a card or paper designated as a recognition certificate, and presenting the recognition certificate to the recipient.

2. A method of promoting self-esteem by assembling a personalized kit whose features comprise—

(a) heart-shaped and colored chips imprinted on one side with the words "Quality Currency" and, on the reverse side, imprinted with one or more character quality words;

(b) heart-shaped and colored chips imprinted on one side with the words "Quality Currency" and having a blank reverse side for hand printing of quality words not found among the imprinted chips;

(c) a two-piece, jug-like container imprinted with the words "Jugs of Hugs" and with a slot for the insertion of the chips;

(d) an enclosure card for recording admirable character qualities and identifying the presenter and/or recipient of the kit;

(e) a set of directions including lists of over 270 examples of admirable character qualities;

(f) a name plate for application to the surface of the container;

(g) a pen which is capable of writing on said chips, said container, any name plate and an enclosure card; and (h) "The Laudable 25 Sense" award chip for recognizing 25 specified character qualities and a recognition certificate listing those same qualities, or an addressed post card to the manufacturer of said kit to obtain such recognition certificate; said method comprising the steps of— identifying the character qualities and/or values recognized and admired in the designated individual for whom the said kit is being assembled;

recording on an enclosure card the identified admirable character qualities/values;

recording on the enclosure card, the name of the recipient and the name of the presenter or the individual assembling the kit;

selecting the preprinted chips which correspond to those qualities identified and recorded;

printing the remaining identified qualities on the blank chips, using a pen;

inserting the selected preprinted chips and the hand printed chips into the container;

inscribing a name plate with the recipient's name by hand printing with a pen or optionally sending or taking it to a professional for engraving;

affixing said name plate to the container;

presenting the assembled personalized kit to the recipient with an accompanying warm embrace; and completing the following three steps only when 25 specified qualities have been identified in the recipient— inserting "The Laudable 25 Sense" award chip into the container, registering the recipient's name on the recognition certificate or completing and returning the post card and, presenting the recognition certificate to the recipient.

* * * * *

UNITED STATES PATENT AND TRADEMARK OFFICE

CERTIFICATE OF CORRECTION

PATENT NO. : 5,013,246

DATED : May 7, 1991

INVENTOR(S) : Nancy L. C. Doyle

It is certified that error appears in the above-identified patent and that said Letters Patent is hereby corrected as shown below:

ON THE TITLE PAGE:

Item [76] should read

Nancy L. Coleman-Doyle

Signed and Sealed this

Tenth Day of November, 1992

*Attest:*

DOUGLAS B. COMER

*Attesting Officer*

*Acting Commissioner of Patents and Trademarks*